US005983804A

United States Patent [19]

Jespersen

[11] Patent Number: 5,983,804

[45] Date of Patent: Nov. 16, 1999

[54] CONVEYOR DEVICE RUNNING ON RAILS

[75] Inventor: Herbert Gøttrup Jespersen, Værløse, Denmark

[73] Assignee: Skako A/S, Faaborg, Denmark

[21] Appl. No.: 08/945,306

[22] PCT Filed: Apr. 25, 1996

[86] PCT No.: PCT/DK96/00186

§ 371 Date: Dec. 8, 1997

§ 102(e) Date: Dec. 8, 1997

[87] PCT Pub. No.: WO96/33897

PCT Pub. Date: Oct. 31, 1996

[30] Foreign Application Priority Data

Apr. 25, 1995 [DK] Denmark ..... 0482/95
Dec. 18, 1995 [DK] Denmark ..... 1433/95

[51] Int. Cl.[6] ..... B61D 5/00

[52] U.S. Cl. ..... 105/241.1; 105/242; 105/247

[58] Field of Search ..... 105/148, 155, 105/241.1, 242, 243, 244, 247

[56] References Cited

U.S. PATENT DOCUMENTS 1,781,281 11/1930 Hogrebe .
2,806,435 9/1957 Mundell ..... 105/242
3,540,380 11/1970 Tumpak et al. ..... 104/246

FOREIGN PATENT DOCUMENTS 2157636 10/1985 United Kingdom .
WO83/00466 2/1983 WIPO .

*Primary Examiner*—Mark T. Le
*Assistant Examiner*—Robert J. McCarry, Jr.
*Attorney, Agent, or Firm*—Jacobson, Price, Holman & Stern, PLLC

[57] ABSTRACT

A rail-travelling conveyor device to be advanced supported by two mutually parallel rails, comprising: a carrier frame, a load compartment substantially firmly connected with the carrier frame, said load compartment being arranged at least partly below the rails, said load compartment having a maximum extent in the longitudinal direction of the rails, a plurality of driving wheels engaging the rails, at least one motor which is connected with the conveyor device and which drives at least one driving wheel. The device is characterized by each driving wheel having a separate rotational shaft connected with the carrier frame, said rotational shafts having rotational axes fixed with respect to the carrier frame, said rotational shafts being arranged within the said maximum extent of the load compartment in the longitudinal direction of the rails, and guide means to guide the conveyor device through curves.

12 Claims, 5 Drawing Sheets

CONVEYOR DEVICE RUNNING ON RAILS

Figure 1:
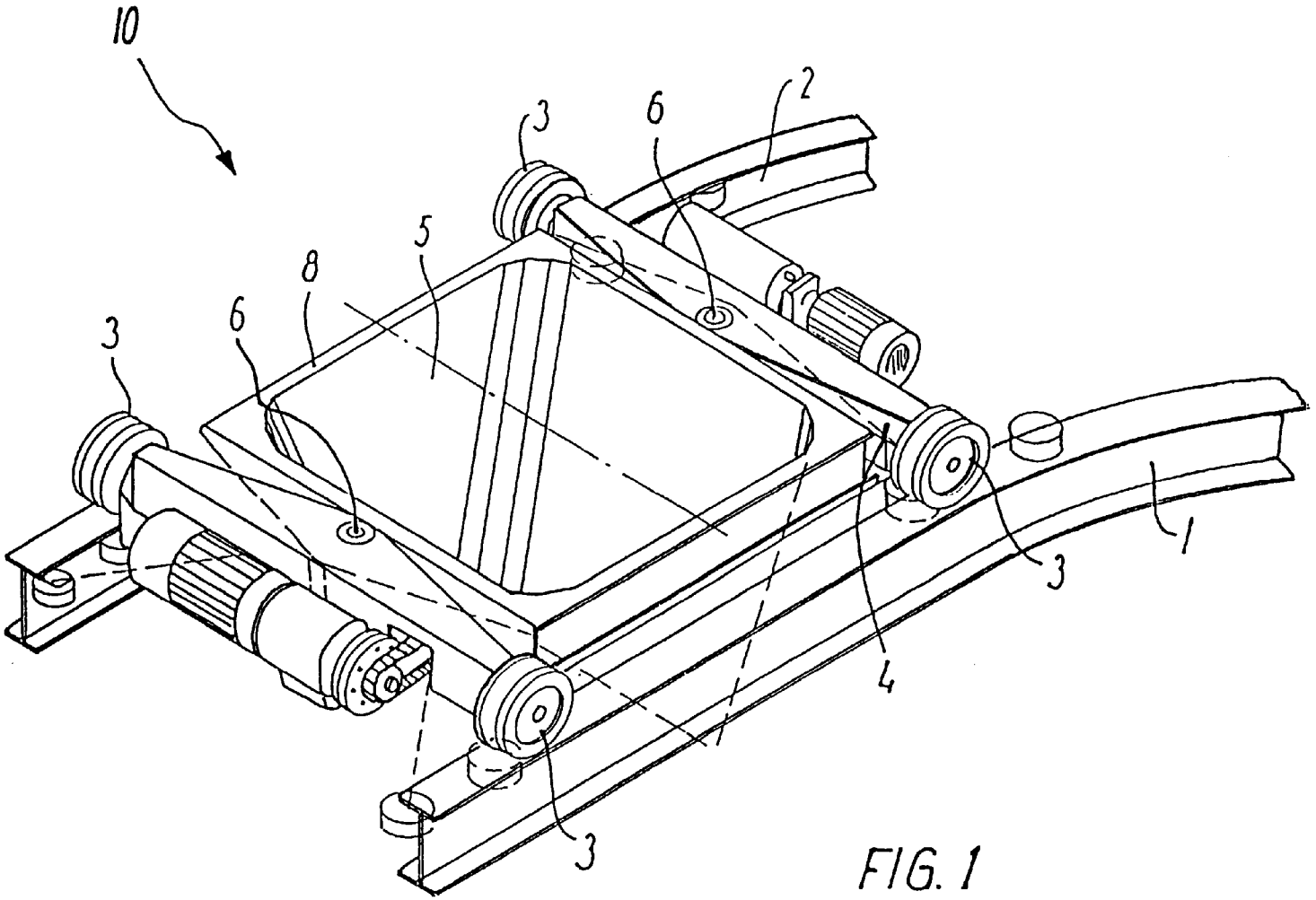
FIG. 1 (PRIOR ART)

The present invention concerns a rail-travelling conveyor device to be advanced supported on two mutually parallel rails and comprising a carrier frame, a load compartment substantially firmly connected with the carrier frame, said load compartment being arranged at least partly below the rails, said load compartment having a maximum extent in the longitudinal direction of the rails, a plurality of driving wheels engaging the rails, and at least one motor which is connected with the conveyor device and which drives at least one driving wheel. In this connection, "firmly" means that, when being advanced, the load compartment is connected with the carrier frame in such a manner that the location of its centre of gravity substantially cannot change with respect to the carrier frame, i.e. the load compartment cannot pivot freely like a pendulum.

Conveyor devices which travel on rails and are used e.g. to feed viscous masses through production systems, are generally known. The conveyor devices may be advanced supported by rail systems, which comprise a single rail or two rails extending mutually in parallel, and which are either supported by columns or are suspended from an overhead structure. The rail systems used may be provided with upward gradients in the longitudinal direction, as required, and may comprise curved track segments and switches allowing the travelling direction of the conveyor devices to be changed.

Whether one rail system or another is selected for a given production system usually depends on the occurring loads from the conveyor devices and on the mutual location of the production buildings. Further, the selection may determined by the simplicity with which the load compartments of the conveyor devices must be capable of being filled with the viscous mass. Particularly in connection with rail systems having two rails extending mutually in parallel, it is possible to fill the conveyor devices from a position centrally above the load compartment, without the access to the access opening of the load compartment being blocked by a rail.

An example of a known conveyor device of the type described in the opening paragraph has been manufactured by the applicant. This known conveyor device is used particularly in production systems for the production of cast concrete objects. In such production systems, the casting of the concrete objects is usually performed in a separate production building which is located at a distance from the production area where the wet concrete is produced. It is thus necessary to be able to transport the liquid concrete rapidly and reliably from one location to another, and this is expediently done by means of the described, known conveyor device, whose load compartment is filled at a filling station in the production building.

However, with this known conveyor device which is advanced supported by two mutually parallel rails, special measures have to be taken when the conveyor devices are to travel through curves. For the conveyor device to travel through curves and bends, the rotational shafts are mounted so as to be rotatable also with respect to the load compartment about a vertical axis, thereby avoiding derailing of the conveyor devices in the-bends. Thus, the conveyor devices have conventionally been provided with two separate (two-wheeled) bogies arranged in front of and behind the load compartment and connected with the carrier frame of the conveyor device by means of a complicated pivot joint. A separate drive means in the form of a motor on the bogie has moreover been mounted in order to propel the conveyor device. In situations where it is necessary to connect all the driving wheels with a drive means, it is thus necessary to mount a drive means on each bogie.

The complicated pivot joint between the bogies and the need for two separate drive means, however, have made the production of the described conveyor devices difficult and more expensive, and, accordingly, an object of the present invention is to provide a simplified conveyor device, which must also be capable of being advanced through bends without any risk of derailing. Further, the conveyor device must also be capable of being produced at a lower cost than the known conveyor devices and moreover be cheaper to operate and maintain.

This is achieved according to the invention by means of a conveyor device of the type described in the opening paragraph, said conveyor device being characterized by each driving wheel having a separate rotational shaft connected with the carrier frame, said rotational shafts having rotational axes fixed with respect to the carrier frame, said rotational shafts being arranged within the said maximum extent of the load compartment in the longitudinal direction of the rails, and by guide means for guiding the conveyor device through bends.

When the driving wheels are provided with separate rotational shafts located within the said maximum extent of the load compartment in the longitudinal direction, and when guide means are provided for guiding the conveyor device through curves, while the rotational shafts have rotational axes fixed with respect to the carrier frame, it has surprisingly been found that it is possible to drive the conveyor devices through bends without any risk of derailing, with an uncomplicated and low-cost bearing structure, while still providing unobstructed access to the load compartment during filling. As the load compartment is arranged at least partly below the rails, so that the centre of gravity is located below the driving wheels, the conveyor device does not tend to tilt during acceleration and deceleration. Thus, it is an essential feature of the invention to avoid a structure with drive shafts that extend between the rails and may thus interfere with the filling of the load compartment or with the storage of the viscous mass in the load compartment, while still allowing the conveyor device to be driven through bends.

The invention moreover allows the driving wheels to be arranged close to each other in the longitudinal direction, so that the conveyor devices can follow the rails in bends and curves with an even smaller risk of derailing.

The invention provides special advantages when the load compartment has an access opening, particularly a filling opening, arranged at a position between and preferably also above the rails, and optionally a discharge opening disposed at a distance below the rails, as the filling opening may preferably have the same dimensions as the load compartment.

When, as stated in claim 3, the conveyor device is provided with respective drives extending at least partly along respective longitudinal sides of the load compartment, said respective drives connecting at least one respective driving wheel with a drive means, it is possible to connect the driving wheels with a single propelling device which may be arranged in front of or behind the load compartment, and which has a drive take-off that may extend to the longitudinal sides of the load compartment.

In a particularly expedient embodiment, the guide means may moreover be arranged on the front and rear ends, respectively, of the carrier frame with respect to the direction of travel and may engage the rails to guide the conveyor device through the curves.

In a further embodiment, the conveyor device may comprise four driving wheels and support means arranged on the front and rear ends, respectively, of the carrier frame with respect to the travelling direction to prevent tilting of the conveyor device under special loads, as, in that case, the support means will provide a support against the rails. This embodiment is particularly expedient in situations where the driving wheels are arranged two and two above each rail with a relatively small mutual spacing. It is also possible to use the support means when just two driving wheels are used.

According to special embodiments of the invention, the guide means and/or the support means may comprise a carrier element having two separate guide wheels and support wheels, respectively, said carrier element itself being mounted for rotation about an axis which extends perpendicularly to the rotational axes of the driving wheels. This enables the guide wheels and the support wheels to yield when moving through bends. The respective carrier elements may be arranged for rotation about a common shaft in a particularly advantageous manner, thereby providing a particularly simplified structure.

It is moreover within the scope of the invention to advance the conveyor devices in engagement with rail systems, where the inner or the outer rails in the curves are provided with a coating of a material of low friction on the travelling surfaces. Hereby, e.g. errors in the travelling geometry may be avoided.

The invention will be described more fully below with reference to a non-limiting embodiment shown in the drawing.

Figure 2:
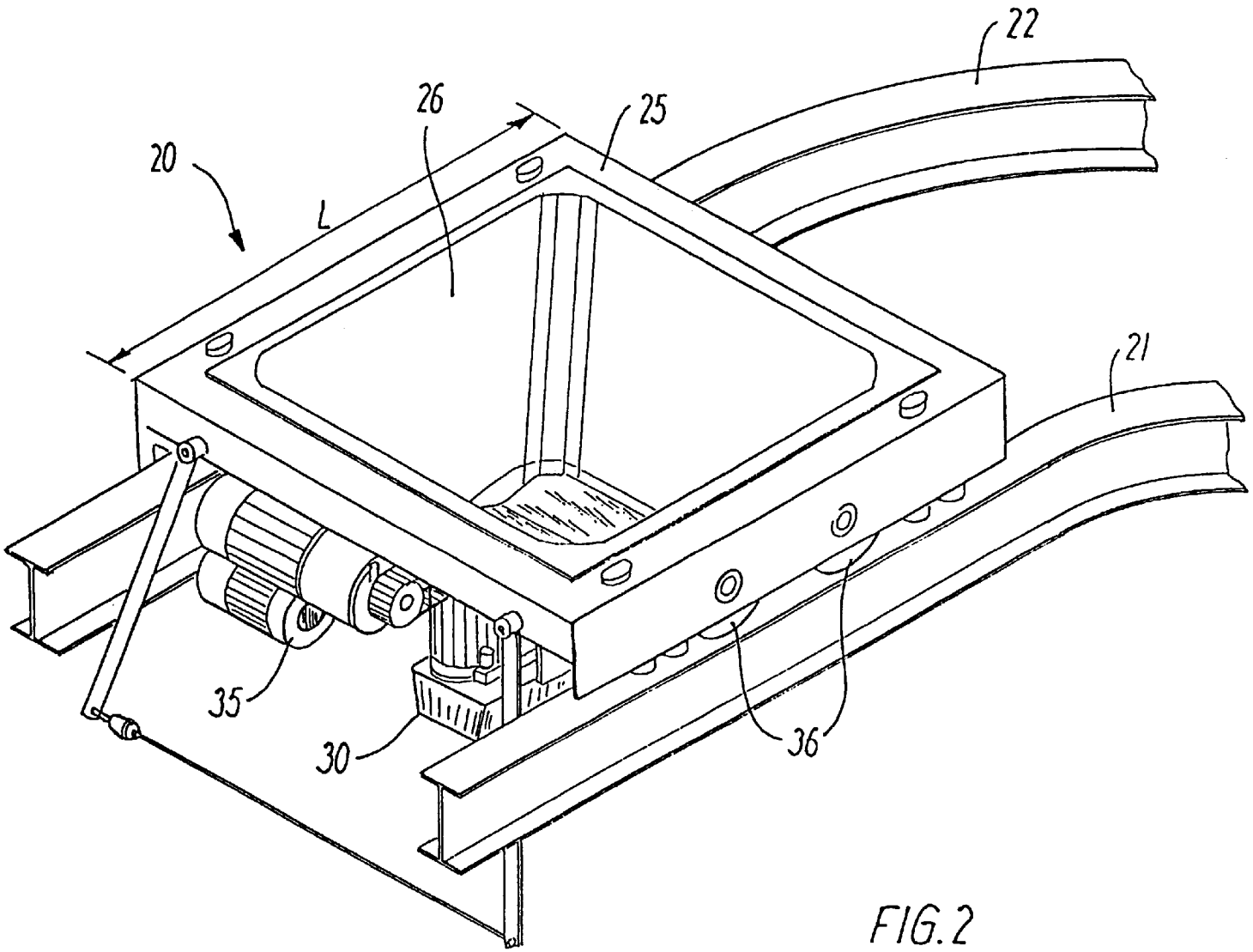
Figure 3:
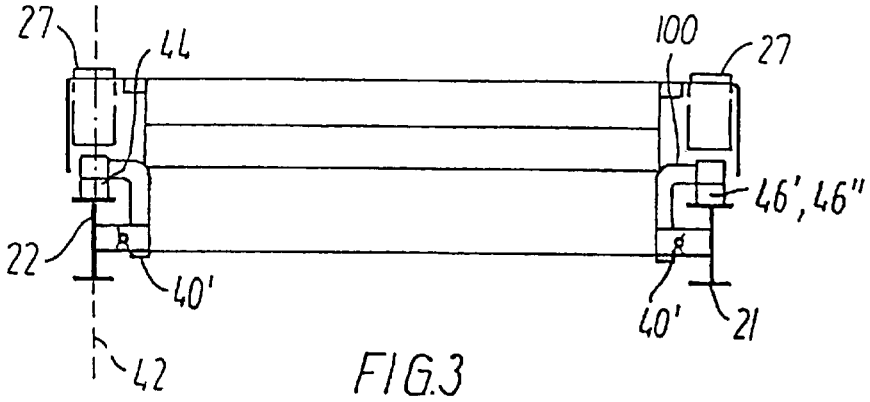
Figure 4:
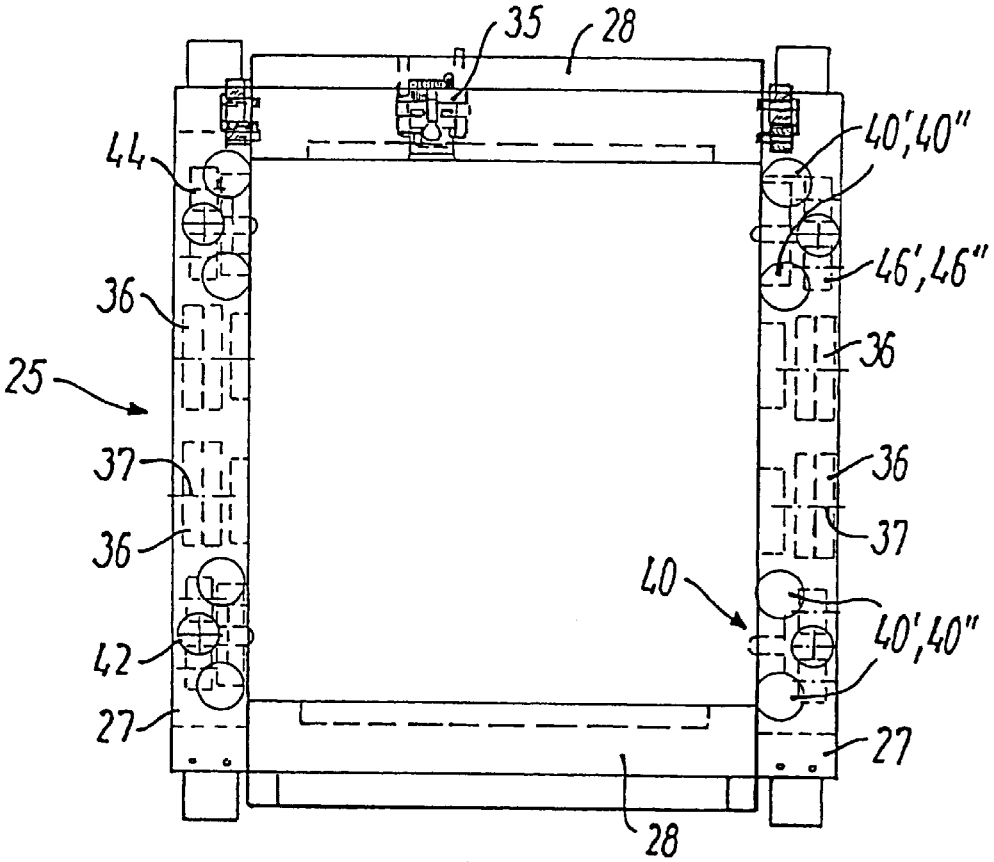
Figure 5:
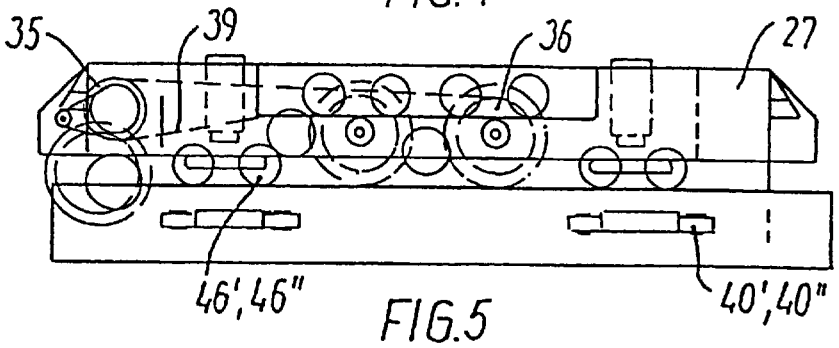
Figure 6:
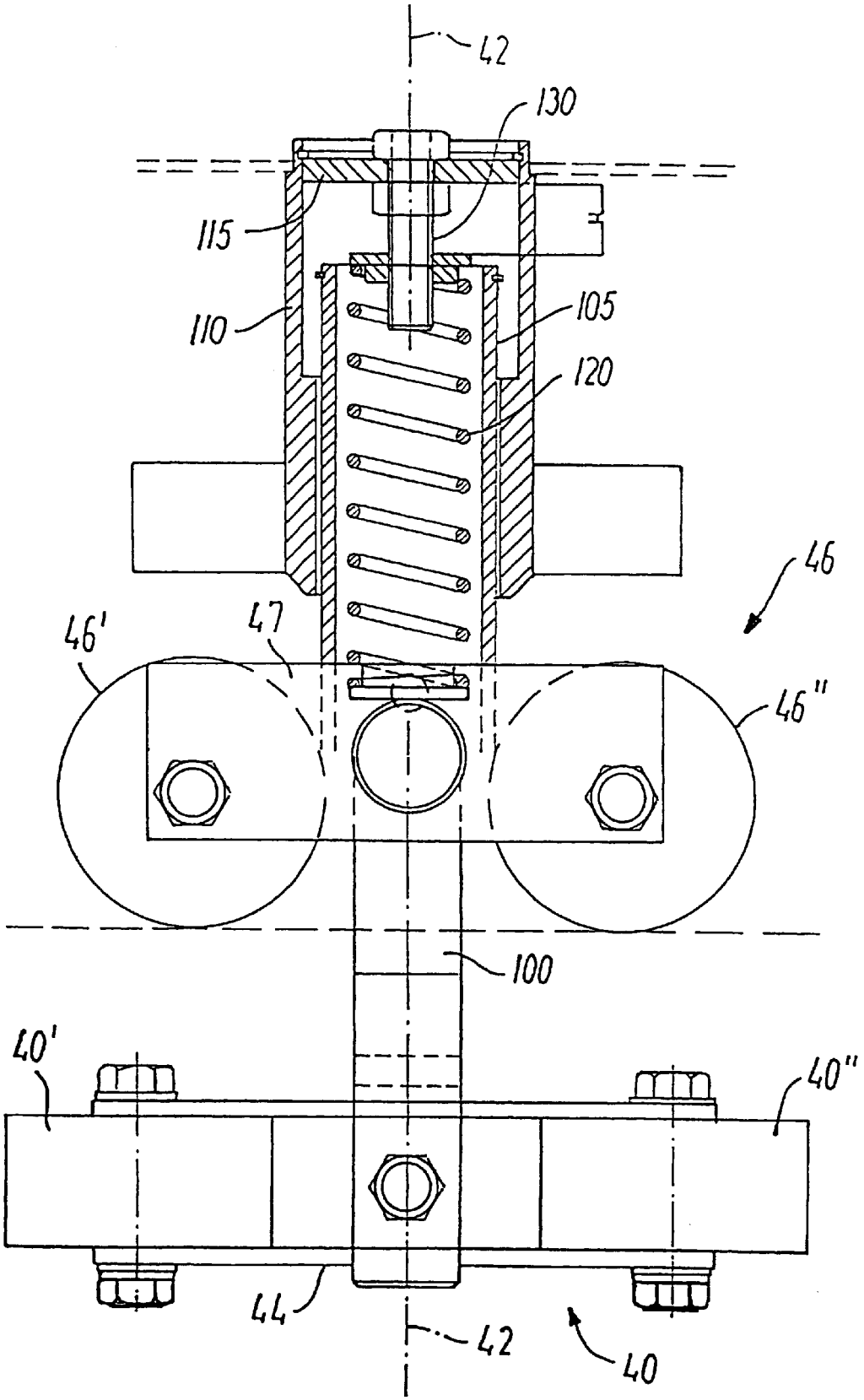
Figure 7:
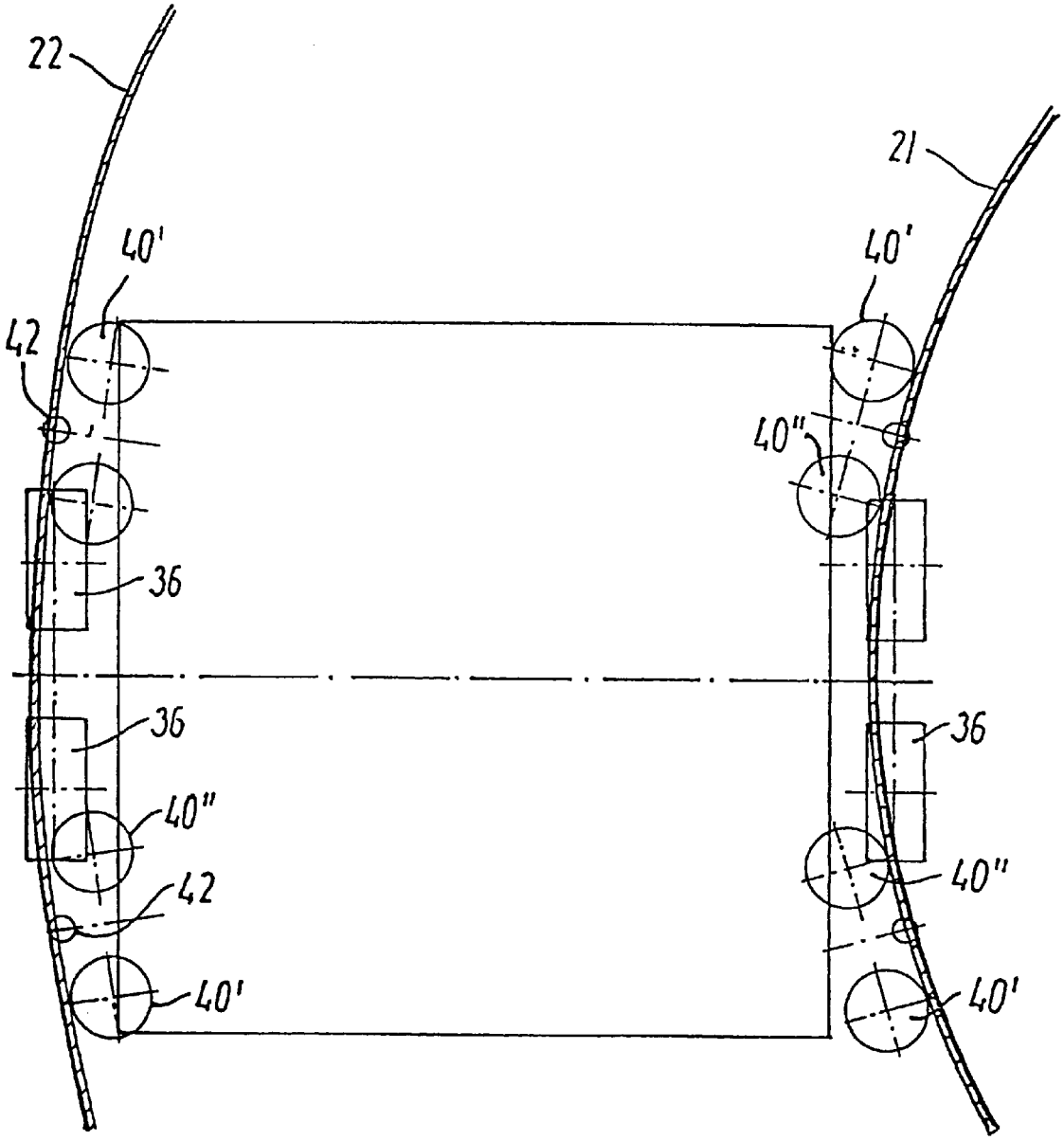

FIG. 1 schematically shows a known conveyor device, seen in perspective view, FIG. 2 schematically shows a conveyor device according to the invention, seen in perspective view, FIG. 3 is a front view of a carrier frame for a conveyor device according to the invention, supported by two parallel rails, FIG. 4 is a top view of the carrier frame illustrated in FIG. 3, FIG. 5 is a lateral view of the carrier frame illustrated in FIG. 3, FIG. 6 is a lateral enlarged view of a carrier element according to the invention, FIG. 7 schematically shows the conveyor device according to the invention when travelling through a bend.

FIG. 1 schematically shows a known conveyor device 10, which is marketed by the applicant. The conveyor device is used particularly in production systems for producing cast concrete objects and is advanced supported by two mutually parallel rails 1, 2. The conveyor device comprises a carrier frame 8, which is firmly connected with a load compartment 5 having a first or upper opening located in a plane above the rails, said load compartment 5, as indicated in broken line, extending at a distance below the plane of the rails and being provided with a second or lower opening (not shown), which may be blocked, and which is used for emptying the load compartment. The conveyor device is moreover provided with four driving wheels 3 connected in pairs with rotational shafts, which extend transversely between the rails, and which are arranged in front of and behind the load compartment. To enable the conveyor device to travel through bends and curves, each of the rotational shafts is mounted for rotation with respect to the load compartment 5 about a vertical axis 6 so as to avoid derailing of the conveyor devices in the bends. Basically, this results in a structure with two separate bogies which are connected with the carrier frame of the conveyor device by means of a pivot joint 6. A separate drive means in the form of a motor which drives the wheels, and a brake are mounted on each bogie.

FIG. 2 schematically shows an embodiment of a conveyor device 20 according to the invention. The conveyor device travels on two parallel rails 21, 22, which may particularly be formed as I profiles having an upwardly directed engagement flange, which expediently forms a carrier face for the driving wheels and support means described below. The rails moreover have a web part which may expediently form an engagement face for the guide means also described below. As will appear, the conveyor device is particularly expedient for use in connection with rail systems having curved rail segments of the type shown in FIG. 2.

The conveyor device 20 is constructed with a carrier frame 25 firmly connected with a load compartment 26, which has an upper filling opening and a lower discharge opening 30 provided at a level below the rails. The conveyor device is used particularly expediently in systems where viscous masses, such as liquid concrete in particular, are to be conveyed rapidly and reliably from one location to another, said load compartment being filled from above at a filling station and emptied at an emptying station located at e.g. floor level below the load compartment and between the rails. The shown load compartment 26 has an extent L in the longitudinal direction of the rails and may optionally be provided with partitions (not shown) which divide the load compartment into independent cells. The conveyor device is additionally provided with four driving wheels 36, of which only two are shown in the figure, and which, in pairs, engage the upper flange of a respective rail 21, 22. The driving wheels may advantageously be constructed as rubber wheels, as the deformation of the rubber material facilitates the travel of the conveyor device through curves. To ensure free access from above to the load compartment, each driving wheel has a separate rotational shaft, which is mounted on the carrier frame 25, and which extends on the outer side of the boundary walls of the load compartment 26. The rotational shafts are fixed with respect to the carrier frame, in the sense that the driving wheels cannot be steered to provide a change in the direction of travel of the conveyor device. It is an essential feature of the invention that the driving wheels 36 are arranged along the extent L of the load compartment 26, preferably relatively close to the line of symmetry at L/2, so that only a limited displacement of the wheels transversely to the rails will take place in bends, thereby obviating derailing of the conveyor device when it travels through the curve shown. The carrier frame 25 moreover mounts a drive motor (drive means) 35 connected by means of suitable drives with the driving wheels to drive these.

Reference is now made to FIGS. 3–5 which show an embodiment of a carrier frame 25 for the conveyor device of the invention in greater detail. The carrier frame is composed of two parallel and longitudinal beams 28 and define a rectangular area in which a load compartment may be mounted. For clarity, the load compartment is not shown, but it will be appreciated that a load compartment is preferably firmly connected with the carrier frame 25 between the beams 27, 28 to be arranged at least partly below the rails 21, 22, as the load compartment 25 is to be filled from above from a position between the rails. A propelling motor 35 is mounted on one of the transverse beams 28 of the carrier frame. As mentioned above, two mutually spaced driving wheels 36 are mounted along each of the longitudinal beams 27, and, according to the invention, these driving wheels have individual, separate rotational shafts 37 which are mounted on the beams.

As appears from FIG. 5 in particular, the propelling motor 35 is connected to the driving wheels by means of respective drives 39, each drive extending at least partly along an associated longitudinal beam 27. It is hereby possible to drive the conveyor device by means of a single propelling motor which can drive all the driving wheels, while the conveyor device may be advanced through curves by guide means 40, which are preferably arranged on the front and rear ends, respectively, of the carrier frame 25 with respect to the direction of travel at a distance from the driving wheels, and which can engage the vertical web part of each rail 21, 22. Preferably, drives are provided along both longitudinal beams so that all driving wheels may be driven, but in some situations it may be relevant not to drive all the drawing wheels.

Each guide means 40 may engage a rail either directly or indirectly and comprises a carrier element 44 in the example shown. The carrier element 44, shown in greater detail in FIG. 6, carries a pair of rotatable guide wheels 40', 40" and is rotatable itself with respect to the carrier frame about a vertical axis 42.

To ensure that the conveyor device does not tilt during e.g. fast accelerations or decelerations in those cases where the driving wheels are arranged very close to each other on each longitudinal beam 27, the carrier frame is moreover provided with support means 46, which are likewise arranged on the front and rear ends, respectively, of the carrier frame with respect to the direction of travel. Like in the example shown, the support means 46 may be formed by a carrier element 47, which carries a pair of rotatable support wheels 46', 46", and which is rotatable with respect to the carrier frame about the said, vertical axis 42. As will be seen from FIG. 6, the carrier element 47 of the support means 46 may be connected with the carrier element 44 of the guide means 40 by a connecting part 100, which results in a quite simple structure. As appears from FIG. 3 in particular, the connecting part 100 is angled. The carrier elements 44, 47 and the connecting part 100 are connected with a pipe section 105, which is received in a bushing 110 mounted on the carrier frame. A spring device 120 is received between an end face 115 in the bushing and an engagement face in the pipe section to provide for spring cushioning of the conveyor device and to allow unobstructed movement of said device through upward and downward gradients along the path of travel. The pipe section 105 can rotate about the vertical axis 42 by means of a pin connection 130.

FIG. 7 schematically shows a conveyor device according to the invention when travelling through a bend. In the figure the rails 21, 22 are just illustrated with their web part. As appears, the guide wheels 40 engage the outer rail 22, thereby guiding the conveyor device through the bend, as the driving wheels 36 will be displaced slightly transversely to the upper horizontal flange of the rail. To minimize motion of the conveyor device transversely to the rails in the bend, the web part of the internal rail 22 has welded thereon a supplementary flange part, which is so adapted that also the internal guide wheels engage the rail. This results in extremely reliable travel of the conveyor device through the bend. As appears, the carrier elements 44 will adjust themselves tangentially to the rails at any time.

EXAMPLE

The conveyor device shown in FIG. 2 was constructed with a frame having a length dimension L of 2200 mm and a transverse dimension of 2000 mm. The load compartment 26, which was connected with the frame, had an opening at the upper side of the frame with a length dimension of 1500 mm and a transverse dimension of 1500 mm, and extended at a distance of 1100 mm below the rails and was provided with a discharge opening at this location. The conveyor device was advanced on rails by means of two pairs of driving wheels 36, each pair of driving wheels being advanced on the upper flange of a respective rail. The driving wheels had a diameter of 320 mm and were mounted with a mutual centre distance (shaft distance) of 500 mm on each side of the line of symmetry of the frame.

I claim:

1. In a rail-travelling conveyor car (20) adapted to be advanced supported by two mutually parallel rails (21, 22), comprising:

a carrier frame (25), a load compartment (26) substantially firmly connected with the carrier frame (25), said load compartment (26) having a predetermined maximum extent (L) in the longitudinal direction of the rails (21, 22), a plurality of driving wheels (36) engaging the rails (21, 22), and at least one motor (35) which is connected with the conveyor car (20) and which drives at least one driving wheel (36), the improvement comprising said load compartment (26) being arranged at least partly below the rails (21, 22), each driving wheel (36) having a separate rotational shaft (37) connected with the carrier frame (25), said rotational shafts (37) having rotational axes fixed with respect to the carrier frame (25), said rotational shafts (37) being arranged within the said predetermined maximum extent (L) of the load compartment (26) in the longitudinal direction of the rails (21, 22), and guide means (40) adapted for engagement with the rails for guiding the conveyor car (20) through curved sections of the rails, said guide means (40) being arranged at a distance from the driving wheels (36) in the direction of travel of the conveyor car (20).

2. The rail-travelling conveyor car according to claim 1, wherein by said load compartment has an upwardly open access opening provided between the rails, said access opening being arranged above the rails.

3. The rail-travelling conveyor car according to claim 1, having respective drives extending at least partly along respective longitudinal sides of the load compartment, said respective drives connecting at least one respective driving wheel with a drive means.

4. The rail-travelling conveyor car according to claim 1, wherein in the guide means are arranged on the front and rear ends, respectively, of the carrier frame with respect to the direction of travel.

5. The rail-travelling conveyor car according to claim 1, having four driving wheels, and support means arranged on the front and rear ends, respectively, of the carrier frame with respect to the direction of travel to prevent tilting of the conveyor car.

6. The rail-travelling conveyor car according to claim 1, wherein the driving wheels are arranged approximately symmetrically about the centre line of gravity of the conveyor car, and the driving wheels are optionally arranged with a mutual centre distance of between about 1 and about 3 times the diameter of the driving wheels.

7. The rail-travelling conveyor car according to claim 1, each guide means comprises a carrier element with separate guide wheels, and that the carrier element is rotatable with respect to the carrier frame.

8. The rail-travelling conveyor car according to claim 5, wherein in each support means comprises a carrier element with two separate support wheels, and the carrier element is rotatable with respect to the carrier frame.

9. The rail-travelling conveyor car according to claim 1, wherein the guide means and the support means are rotatable in pairs with respect to the conveyor car about the same axis.

10. A rail-travelling conveyor car according to claim 1, wherein the motor is mounted on the carrier frame.

11. The system having rail-travelling conveyor cars according to claim 1 and having two parallel rails, wherein the upper travelling faces of the outer or the inner rails in the curves are provided with a coating of a material of low friction.

12. The system according to claim 11, wherein the rails have a substantially upwardly directed flange, and the driving wheels engage said flange.

* * * * *